US007348477B2

(12) United States Patent
Ishihara et al.

(10) Patent No.: US 7,348,477 B2
(45) **Date of Patent: *Mar. 25, 2008**

(54) ELECTRONIC KEYBOARD MUSICAL INSTRUMENT

(75) Inventors: Hideki Ishihara, Hamamatsu (JP); Naohisa Mori, Hamakita (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/241,129

(22) Filed: Sep. 29, 2005

(65) Prior Publication Data

US 2006/0027070 A1 Feb. 9, 2006

Related U.S. Application Data

(60) Division of application No. 11/016,307, filed on Dec. 17, 2004, now Pat. No. 6,972,358, which is a division of application No. 10/722,328, filed on Nov. 24, 2003, now Pat. No. 6,888,053, which is a continuation of application No. 10/243,881, filed on Sep. 13, 2002, now abandoned.

(30) Foreign Application Priority Data

Sep. 19, 2001 (JP) ..... 2001-285072

(51) Int. Cl.
*G10C 3/02* (2006.01)

(52) U.S. Cl. ..... 84/177; 84/718

(58) Field of Classification Search ..... 84/177, 84/174, 176, 186.1, 184, 185, 175
See application file for complete search history.

(56) References Cited

U.S. PATENT DOCUMENTS 3,338,127 A 8/1967 Englebert
4,058,045 A * 11/1977 Jennings et al. ..... 84/731
5,465,644 A 11/1995 Shimoda et al.
5,550,926 A * 8/1996 Tsao ..... 381/386

(Continued)

FOREIGN PATENT DOCUMENTS

JP 352026821 2/1977

(Continued)

OTHER PUBLICATIONS

Kawai es1, Keyboard Magazine, Jan. 2001, Partial Translation.

*Primary Examiner*—Lincoln Donovan
*Assistant Examiner*—Jianchun Qin
(74) *Attorney, Agent, or Firm*—Morrison & Foerster LLP

(57) ABSTRACT

Casing of an electronic keyboard musical instrument includes two discrete parts: a main casing section; and a rear casing section. The main casing section includes a bottom plate having a keyboard section placed thereon, a keyslip portion extending upward from the bottom plate in front of the keyboard section, and left and right side plates extending upward from the bottom plate at left and right sides of the keyboard section. The rear casing section includes a roof plate forming a rear upper surface of the casing, and a back plate extending downward from a rear edge of the roof plate. The rear casing section is detachably attached to the main casing section by means of a slidingly-attaching structure for slidingly attaching the rear casing section to the left and right side plates of the main casing section.

2 Claims, 7 Drawing Sheets

U.S. PATENT DOCUMENTS

| | | | | |
|---|---|---|---|---|
| 5,789,693 | A * | 8/1998 | Lawson | 84/744 |
| 6,180,859 | B1 * | 1/2001 | Konishi | 84/174 |
| 6,888,053 | B2 * | 5/2005 | Ishihara et al. | 84/177 |

FOREIGN PATENT DOCUMENTS

| | | | |
|---|---|---|---|
| JP | 53-84331 | | 7/1978 |
| JP | 54-25819 | | 2/1979 |
| JP | S59-142368 | | 9/1984 |
| JP | 62-103382 | | 7/1987 |
| JP | 1288900 | | 11/1989 |
| JP | 5-75797 | U | 10/1993 |
| JP | 05-76190 | U | 10/1993 |
| JP | 05-307390 | A | 11/1993 |
| JP | 5-96888 | U | 12/1993 |
| JP | 06-027956 | A | 2/1994 |
| JP | 6-21096 | U | 3/1994 |
| JP | 6-26386 | U | 4/1994 |
| JP | 6250648 | | 9/1994 |
| JP | HEI-07-23837 | | 5/1995 |
| JP | 2516897 | Y2 | 8/1996 |
| JP | 10-207461 | A | 8/1998 |

* cited by examiner

ELECTRONIC KEYBOARD MUSICAL INSTRUMENT

CROSS-REFERENCE TO RELATED APPLICATION

This application is a division of U.S. application Ser. No. 11/016,307 filed Dec. 17, 2004, now U.S. Pat. No. 6,972,358 which in turn is a division of U.S. application Ser. No. 10/722,328 filed on Nov. 24, 2003, now U.S. Pat. No. 6,888,053 which is a continuation of application Ser. No. 10/243,881, filed on Sep. 13, 2002 (now abandoned), all of which are specifically incorporated herein, in their entirety, by reference.

BACKGROUND OF THE INVENTION

The present invention relates generally to electronic keyboard musical instruments, and more particularly to an improvement in casing structures of the electronic keyboard musical instruments.

In electronic keyboard musical instruments having a generally flat casing, the casing structure includes a bottom plate having a keyboard section placed thereon, a keyslip portion disposed right in front of the keyboard section, a pair of left and right side plates located close to the left and right sides of the keyboard section, and a roof plate forming a rear upper surface of the casing, and a bottom plate. However, when maintenance and inspection operations are to be performed on the interior of the casing, it is very troublesome to disassemble and then re-assemble the thus-constructed casing structure.

Japanese Utility Model Laid-open Publication No. SHO-62-103382 discloses an electronic keyboard musical instrument having an improved casing. The improved casing is composed of a main casing section and a rear casing section integrally forming a rear upper surface of the casing. The rear casing section is hinged to a bottom plate of the main casing section so that the rear casing section can be pivotally moved between open and closed positions. However, in assemblage of the casing, last screwing for fastening the rear casing section to the main casing section is performed, without exception, on the upper surface of the casing, so that the screw heads are inevitably exposed on the upper surface of the casing, presenting undesirable external appearance. Further, because the rear casing section is not detachably attachable to the main casing section in the disclosed casing, the assembling operations tend to be very troublesome, and maintenance and inspection of circuit boards etc. within the casing are also difficult to perform.

Further, in the electronic keyboard musical instruments of the above-mentioned types, the main circuit board is mounted on the bottom plate, for ease of the maintenance and inspection. However, where the main circuit board is to be mounted on the bottom plate near the back of the keyboard section, the bottom place must have an increased horizontal dimension in a front-and-back direction of the casing, which would therefore increase the overall horizontal dimension, in the front-and-back direction, of the keyboard musical instrument. Further, where the main circuit board is to be mounted on the bottom plate under the keyboard section, the overall vertical dimension or thickness of the keyboard musical instrument would increase.

SUMMARY OF THE INVENTION

In view of the foregoing, it is an object of the present invention to provide an electronic keyboard musical instrument having an improved casing structure which allows a instrument's casing to be assembled with increased ease and in such a manner as to achieve good external appearance, and which can facilitate maintenance and inspection of the interior of the casing.

In order to accomplish the above-mentioned object, the present invention provides an electronic keyboard musical instrument comprising a keyboard section and a casing that accommodates therein the keyboard section. In the present invention, the casing comprises: a main casing section including a bottom plate having the keyboard section placed thereon, a keyslip portion extending upward from the bottom plate in front of the keyboard section, and left and right side plates extending upward from the bottom plate at left and right sides of the keyboard section; a rear casing section including a roof plate forming a rear upper surface of the casing, and a back plate extending downward from a rear edge of the roof plate; and a slidingly-attaching structure that slidingly attaches the rear casing section to the main casing section. Thus, the rear casing section is detachably attachable to the main casing section to constitute the casing. Because, in the present invention, the rear casing section and main casing section, constituting the casing, are discrete or separate parts and the rear casing section is detachably attached to the main casing section by means of the slidingly-attaching structure, the casing can be assembled and/or disassembled with ease and in such a manner as to achieve good external appearance, and there can be provided an improved casing structure which facilitates maintenance and inspection of the interior of the casing.

The present invention also provides an electronic keyboard musical instrument comprising a keyboard section and a casing that accommodates therein the keyboard section, where the casing comprises: a main casing section including a bottom plate having the keyboard section placed thereon, and a keyslip portion extending upward from the bottom plate in front of the keyboard section; a rear casing section including a roof plate forming a rear upper surface of the casing, and a back plate extending downward from a rear edge of the roof plate; and left and right side plates extending upward from the bottom plate at left and right sides of the keyboard section, the left and right side plates belonging to and being formed integrally with either one of the main casing section and the rear casing section. In this invention, a circuit board of an operation panel and a main circuit board of the electronic keyboard musical instrument are provided on the rear casing section, so that the rear casing section is detachably attached to the main casing section along with the individual circuit boards. Because, in the present invention, the rear casing section and ma n casing section, constituting the casing, are discrete or separate parts and the rear casing section, having the individual circuit boards provided thereon, is detachably attachable to the main casing section, the casing can be assembled and/or disassembled with ease, and maintenance and inspection of the interior of the casing can be performed with utmost ease.

The present invention also provides an electronic keyboard musical instrument comprising a keyboard section and a casing that accommodates therein the keyboard section, where the casing comprises: a bottom plate having said keyboard section placed thereon; a keyslip portion extending upward from said bottom plate in front of said keyboard section; left and right side plates extending upward from said bottom plate at left and right sides of said keyboard section; a roof plate forming an upper surface of said casing; and a back plate extending downward from a rear edge of said roof plate, wherein said casing can be disassembled into said main casing section, including said bottom plate and said keyslip portion, and said rear casing section including at least said back plate, and wherein a circuit board of an operation panel and a main circuit board of said electronic keyboard musical instrument are provided on said rear casing section, whereby said rear casing section is detachably attached to said main casing section along with individual ones of said circuit boards.

While the embodiments to be described herein represent the preferred form of the present invention, it is to be understood that various modifications will occur to those skilled in the art without departing from the spirit of the invention. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION OF THE INVENTION

Figure 1A:
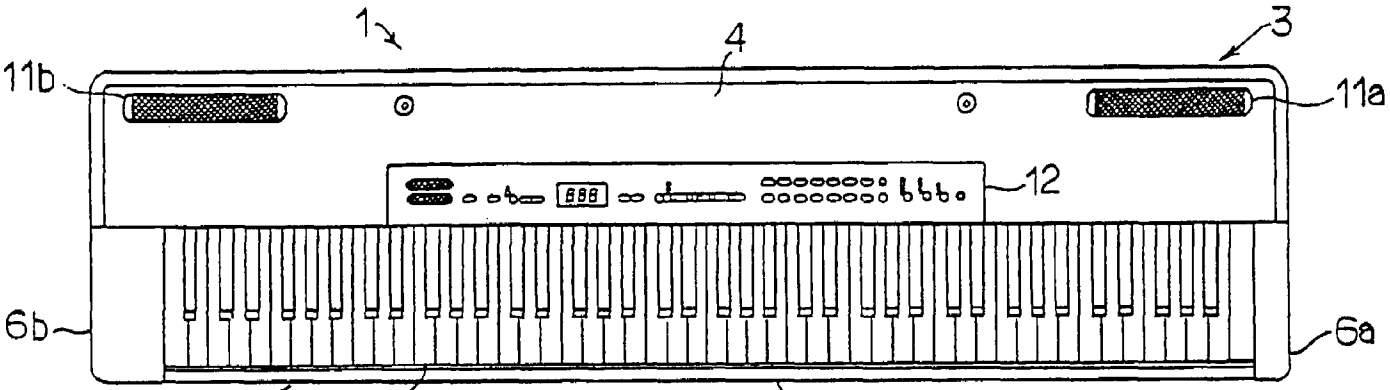
FIGS. 1A, 1B and 1C are top plan, rear and bottom views, respectively, of an electronic keyboard musical instrument in accordance with an embodiment of the present invention.
Figure 1B:
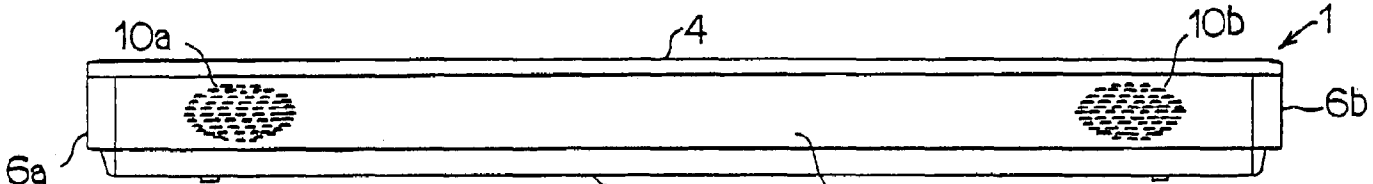
Figure 1C:
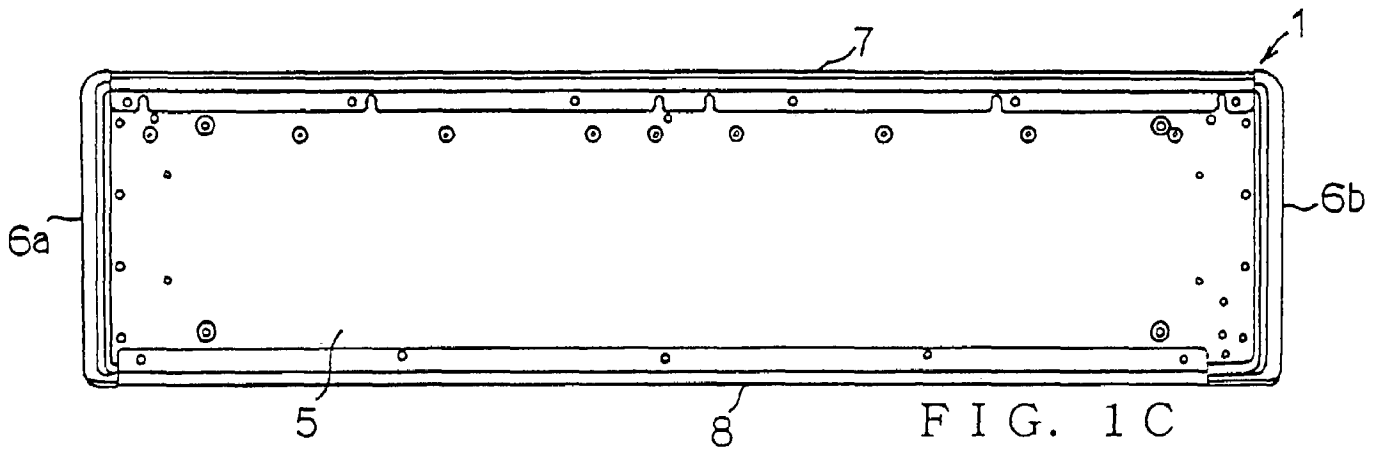
Figure 2:
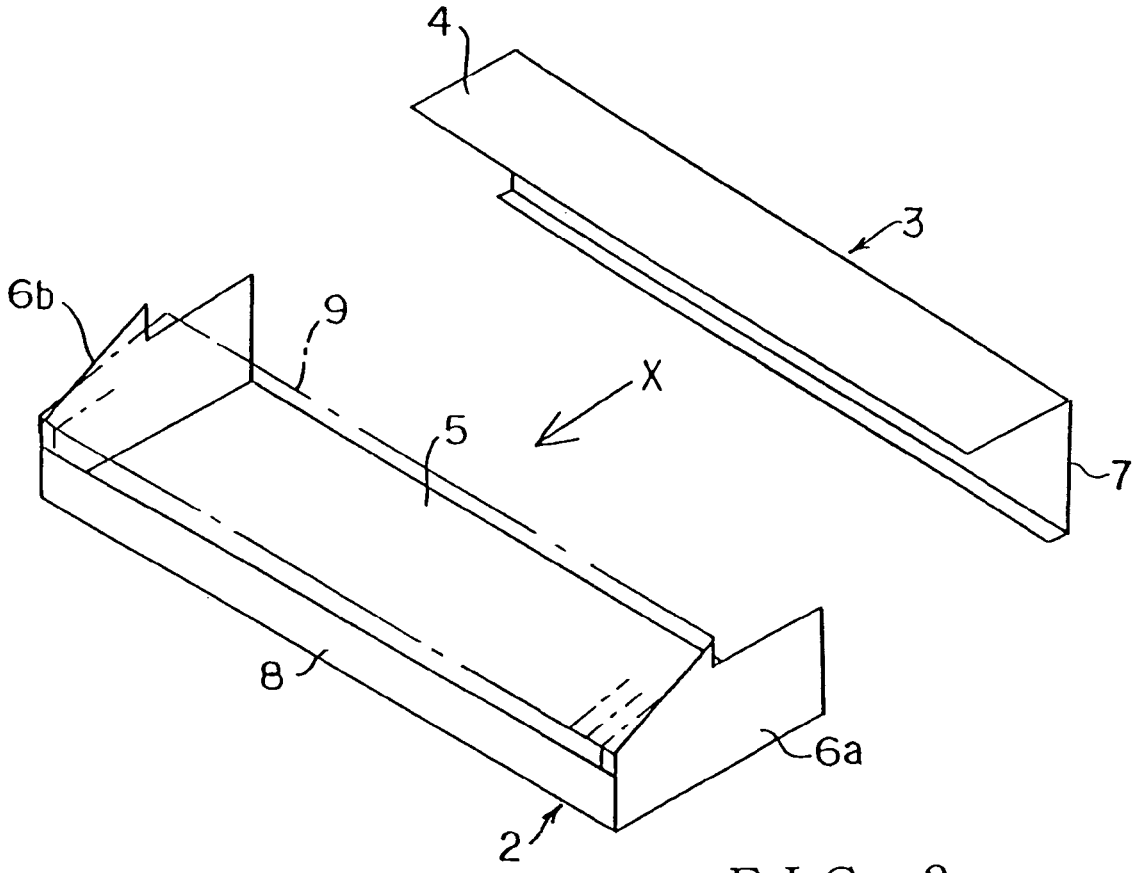
FIG. 2 is an exploded view of a casing of the electronic keyboard musical instrument where a main casing section and a rear casing section are constructed as discrete or separate parts.

FIG. 1A is a top plan view showing an electronic keyboard musical instrument in accordance with an embodiment of the present invention, FIG. 1B is a rear view of the electronic keyboard musical instrument, and FIG. 1C is a bottom view of the electronic keyboard musical instrument. The electronic keyboard musical instrument includes a casing 1, which generally comprises a main casing section 2 and a rear casing section 3 constructed as discrete parts. As schematically shown in FIG. 2, the rear casing section 3 is removably attached to the main casing section 2. The main casing section 2 has a bottom plate 5 having a keyboard section 9 placed thereon, a keyslip portion 8 extending upward from the bottom plate 5 right in front of the keyboard section 9, and a pair of right and left side plates 6*a*, 6*b* extending upward from the bottom plate 5 at left and right sides of the keyboard section 9. These bottom plate 5, side plates 6*a*, 6*b* and keyslip portion 8 are secured to one another by suitable fastening means, such as screws. The rear casing section 3 has a top or roof plate 4 that forms a rear upper surface of the casing 1, and a back plate 7 extending downward from a rear edge of the roof plate 4. The roof plate 4 and back plate 7 are secured to each other by suitable fastening means, such as screws. As illustrated in FIG. 1B, the back plate 7 of the rear casing section 3 has two main tone holes 10*a* and 10*b*, formed in predetermined positions thereof, for emitting sounds from left and right speakers (not shown). Further, as seen in FIG. 1A, the roof plate 4 has subsidiary tone holes 11*a* and 11*b*, formed in predetermined portions thereof, for emitting acoustical vibrations from the backside of the speakers. On the roof plate 4, there is also provided an operation panel 12 including various operating switches, displays, etc.

The rear casing section 3 is attached to the main casing section 2 via a slidingly-attaching structure, which slidingly fastens the rear casing section 3 to the right and left side plates 6*a* and 6*b* of the main casing section 2. In the instant embodiment, the slidingly-attaching structure comprises a set of elements provided on the lower surface of the roof plate 4 in the rear casing section 3, and a set of elements provided on the upper ends of the right and left side plates 6*a* and 6*b* in the main casing section 2.

Figures 3A, 3B, 3C:
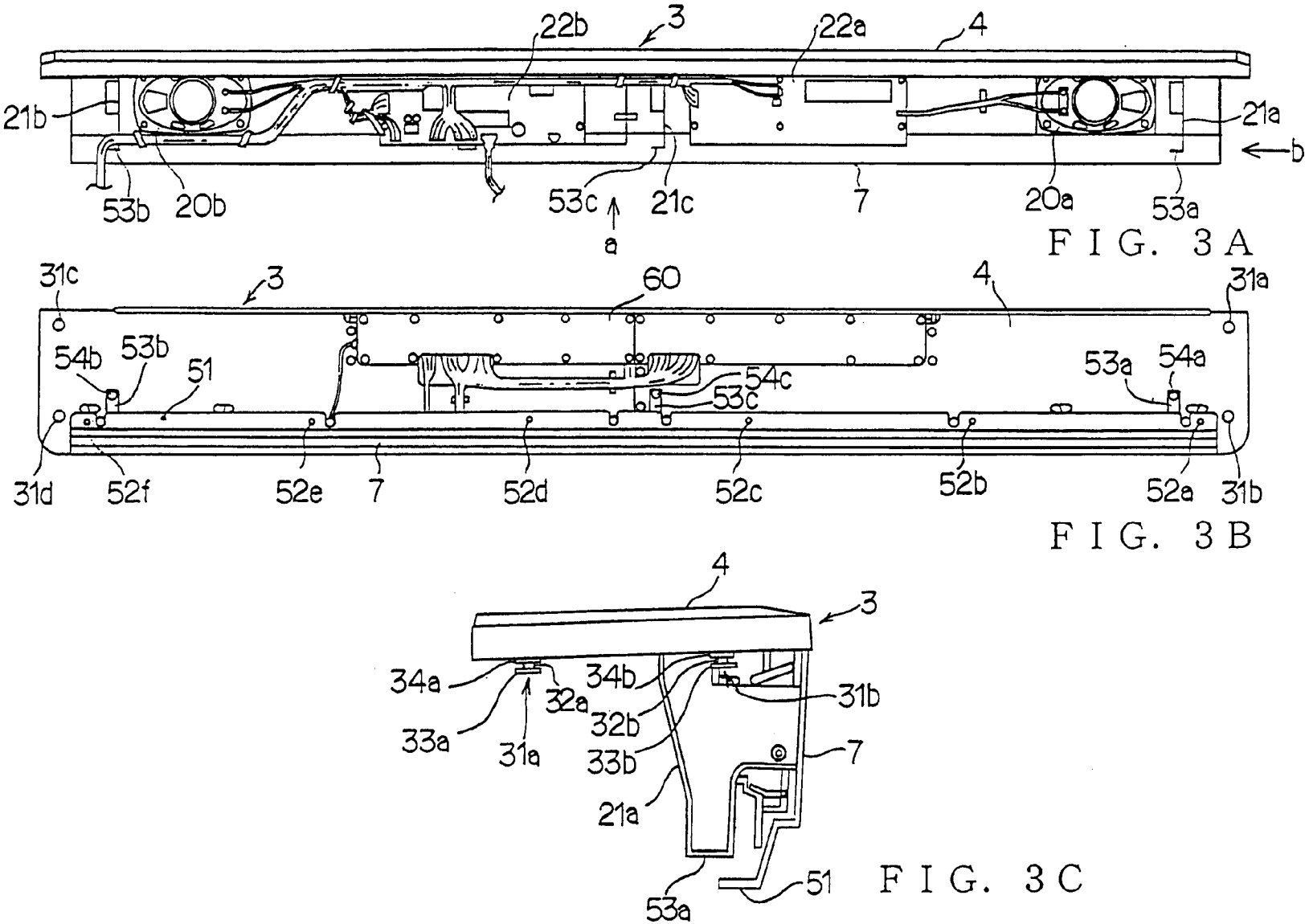
FIG. 3A is a front elevational view of the rear casing section of the electronic keyboard musical instrument.
FIG. 3B is a bottom view of the rear casing section.
FIG. 3C is a side view of the rear casing section.

This and following paragraphs describe exemplary details of the rear casing section 3, with reference to FIGS. 3A to 3C. FIG. 3A is a front elevational view of the rear casing section 3, which particularly depicts the inner surface of the back plate 7 as seen from the interior of the casing 1. FIG. 3B is a bottom view of the rear casing section 3, which particularly depicts the underside of the roof plate 4 as viewed in a direction of arrow "a" of FIG. 3A, and FIG. 3C is a right side view of the rear casing section 3, which particularly depicts a side surface of the rear casing section 3 as viewed in a direction of arrow "b" of FIG. 3A. As seen from FIG. 3C, the roof plate 4 and back plate 7 constituting the rear casing section 3 are coupled at right angles with each other, and the coupling between the roof plate 4 and the back plate 7 is reinforced by right and left and middle vertical securing plates 21*a* to 21*c*. In FIG. 3C, the right vertical securing plate 21*a* has a rear end connected to the back plate 7 and an upper end connected to the roof plate 4, and the right securing plate 21*a* also has a lower end portion 53*a* bent horizontally outward from its vertical portion. As will be later described, the horizontally-bent lower end portion 53*a* of the right securing plate 21*a* can be secured to the bottom plate 5 by means of a screw or the like. The other vertical securing plates 21*b* and 21*c* are constructed in a similar manner to the right securing plate 21*a*. As seen in FIG. 3A, speakers 20*a* and 20*b* are provided on predetermined positions of the back plate 7 near left and right ends of the back plate 7. The middle securing plate 21*c* also functions as an acoustic separator between the speakers 20*a* and 20*b*. Further, the back plate 7 has a lower end edge 51 bent horizontally inward, which is secured to and along one edge of the bottom plate 5 by means of screws or the like.

As further shown in FIG. 3B, the roof plate 4 has projections 31*a* to 31*d* formed at predetermined positions of its underside near right and left ends thereof so that the projections 31*a* to 31*d* can function as elements of the slidingly-attaching structure for slidingly attaching the rear casing section 3 to the right and left side plates 6*a* and 6*b*. As seen in FIGS. 3B and 3C, the slidingly-attaching projections 31*a* and 31*b* are provided on a predetermined right end portion of the underside or inner surface of the roof plate 4 and located adjacent to front and rear edges, respectively, of the roof plate 4. These right slidingly-attaching projections 31*a* and 31*b* each have a screw head 33*a* or 33*b* formed at its distal end and a proximal-end flange 34*a* or 34*b* spaced from the screw head 33*a* or 33*b* by a predetermined distance; thus, a gap portion 32*a*, 32*b* is formed between the screw head 33*a*, 33*b* and the flange 34*a*, 34*b*. The slidingly-attaching projections 31*c* and 31*d*, provided on a predetermined left end portion of the underside or inner surface of the roof plate 4, are constructed similarly to the right slidingly-attaching projections 31*a* and 31*b*.

Figure 4:
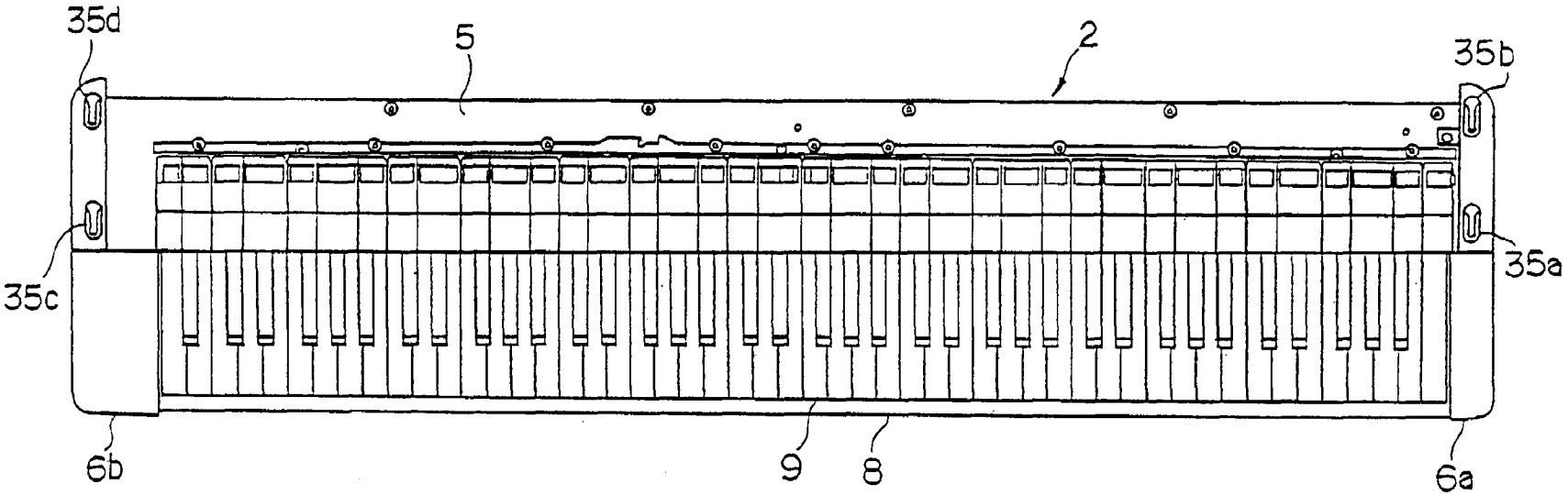
FIG. 4 is a top plan view of the main casing section of the electronic keyboard musical instrument.
Figure 5A:
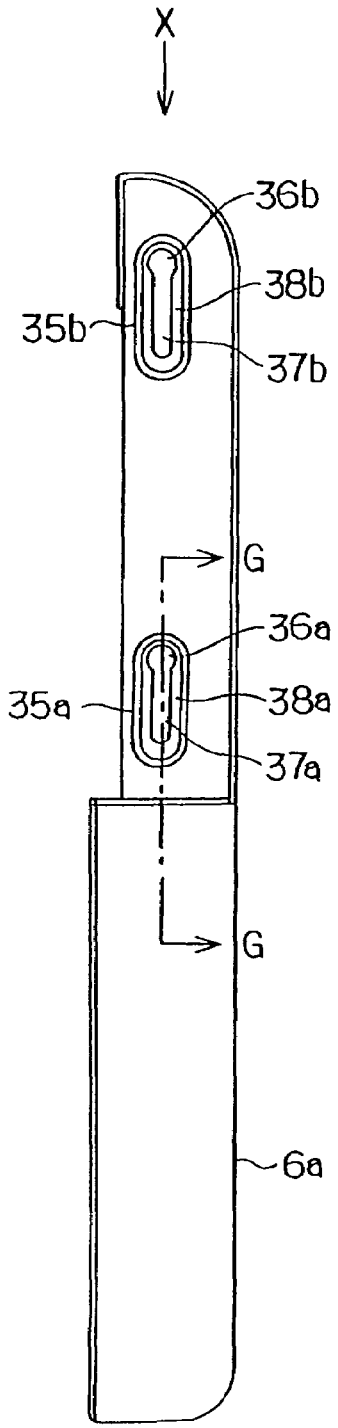
FIG. 5A is a plan view explanatory of a slidingly-attaching structure of the casing in the electronic keyboard musical instrument.
Figure 5B:
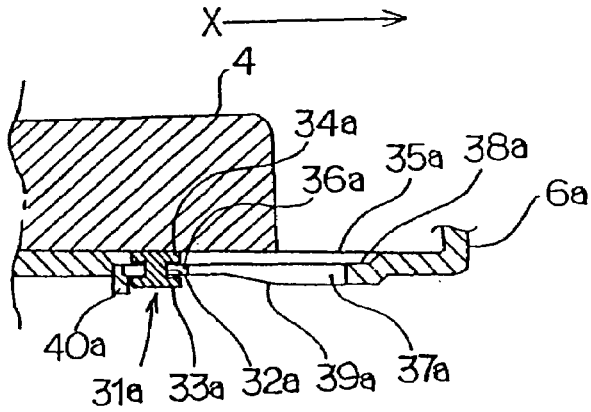
FIG. 5B is a sectional view taken along the G-G line of FIG. 5A.

This and following paragraphs describe examples of elements of the slidingly-attaching structure provided on the right and left side plates 6*a* and 6*b* of the main casing section 2, with reference to FIGS. 4 and 5. Specifically, FIG. 4 is a top plan view of the main casing section 2, and FIG. 5A is an enlarged top plan view of the right side plate 6*a*. Slide portions 35*a* to 35*d* are provided on rear upper surfaces of the right and left side plates 6*a* and 6*b* of the main casing section 2, at positions corresponding to the slidingly-attaching projections 31*a* to 31*d* of the rear casing section 3. As illustrated in FIG. 5A, each of the slide portions 35*a*, 35*b* of the right side plate 6*a* has a large opening 36*a*, 36*b*, an elongated opening 37*a*, 37*b* communicating with the large opening 36*a*, 36*b* and extending from the large opening 36*a*, 36*b* in a forward direction of the casing 1, and a recessed portion 38*a*, 38*b* surrounding the corresponding large opening 36*a*, 36*b* and elongated opening 37*a*, 37*b*. Each of the large opening 36*a*, 36*b* has such a diameter as to allow passage therethrough of the screw head 33*a*, 33*b* of the corresponding slidingly-attaching projection 31*a*, 31*b*. Each of the elongated opening 37*a*, 37*b* has a width smaller than the diameter of each of the screw head 33*a*, 33*b* and flange 34*a*, 34*b* of the corresponding slidingly-attaching projection 31*a*, 31*b*. When the rear casing section 3 and main casing section 2 are joined, the flanges 34*a*, 34*b* of the slidingly-attaching projections 31*a*, 31*b* are fitted in the recessed portions 38*a*, 38*b*, respectively; namely, the recessed portions 38*a*, 38*b* each have a width and depth corresponding to the dimensions of the flange 34*a*, 34*b*. The reverse side of each of the recessed portions 38*a*, 38*b* is tapered to provide a slanted or tapered surface 39*a* of FIG. 5B. Slide portions 35*c* and 35*d* of the left side plate 6*b* are constructed in the same manner as the above-described slide portions 35*a* and 35*b* of the right side plate 6*a*.

To attach the rear casing section 3 to the main casing section 2, the rear casing section 3 is first placed in a predetermined position from behind the main casing section 2 as shown in FIG. 2, and the screw heads 33*a*, 33*b* of the slidingly-attaching projections 31*a* to 31*d* are inserted into the corresponding large openings 36*a*, 36*b* of the slide portions 35*a* to 35*d* formed on the right and left side plates 6*a* and 6*b*. Then, the entire rear casing section 3 is caused to slide in the forward direction as indicated by arrow "X". FIG. 5B is a sectional view taken along the G-G line of FIG. 5A, which shows the slide portion 35*a* having the corresponding projection 31*a* inserted therein. In this state, the flanges 34*a*, 34*b* of the individual projections 31*a* to 31*d* are positioned in the corresponding recessed portions 38*a*, 38*b* of the slide portions 35*a* to 35*d*, the gap portions 32*a*, 32*b* of the individual projections 31*a* to 31*d* are positioned at the same height as the corresponding large openings 36*a*, 36*b* of the slide portions 35*a* to 35*d*, and the screw heads 33*a*. 33*b* of the projections 31*a* to 31*d* project downwardly beyond the corresponding large openings 36*a*, 36*b*. Then, as the rear casing section 3 (roof plate 4 in FIG. 5B) is caused to slide in the forward direction, i.e. in the arrow "X" direction, the gap portions 32*a*, 32*b* of the individual projections 31*a* to 31*d* are guided forward along the corresponding elongated openings 37*a*, 37*b*, so that the entire rear casing section 3 can slide forward until it is ultimately attached to the main casing section 2.

In each of the slide portions 35*a* to 35*d*, the reverse side of the recessed portion 38*a*, 38*b* is tapered to provide the slanted or tapered surface 39*a* extending over a predetermined range. The tapered surface 39*a* slopes downwardly toward the front of the keyboard musical instrument, so that the thickness of the slide portion progressively increases in a direction toward the front of the keyboard musical instrument. Thus, in the region where the tapered surface 39*a* is formed, the thickness of each of the slide portions 35*a* to 35*d* progressively becomes greater than the vertical width or depth of the corresponding gap portion 32*a* or 32*b*. As a consequence, after the rear casing section 3 is completely slid to the predetermined mounting position on the main casing section 2, the slide portions 35*a* to 35*d* are firmly held in the corresponding gap portions 32*a*, 32*b*, i.e. between the screw heads 33*a*, 33*b* and the flanges 34*a*, 34*b*. Namely, the screw heads 33*a*, 33*b* engaging with the slanted surfaces 39*a* are pressed downward by the thickness of the corresponding slide portions 35*a* to 35*d*, and thus the roof plate 4 of the rear casing section 3 is firmly pressed against the side plates 6*a* and 6*b* and thereby fixed in place. In the above-mentioned manner, the rear casing section 3 can be properly attached to the main casing section 2 by being slid forward into locking engagement by the side plates 6*a* and 6*b*.

As also illustrated in FIG. 5B, each of the slide portions 35*a* to 35*d* has an adjusting protrusion 40*a* at a rear end of its underside. The adjusting protrusion 40*a* is provided right behind the large opening 36, 36*b* of each of the slide portions 35*a* to 35*d*. As the rear casing section 3 is slide rearward for detachment or removal from the main casing section 2, the screw heads 33*a*, 33*b* of the slidingly-attaching projections 31*a* to 31*d* are stopped from sliding rearward, by engaging with the corresponding adjusting protrusions 40*a*. By the provision of such adjusting protrusions 40*a*, the screw heads 33*a*, 33*b* of the slidingly-attaching projections 31*a* to 31*d* can be positioned immediately below the corresponding large openings 36*a*, 36*b*, which facilitates smooth operations for detaching the rear casing section 3 from the main casing section 2.

The main casing section 2 and rear casing section 3, interconnected via the above-described slidingly-attaching structure, are also connected with each other between the bottom plate 5 of the main casing section 2 and the rear lower end of the rear casing section 3, in order to reinforce and make more reliable the coupling between the main casing section 2 and rear casing section 3.

As illustrated in FIG. 3C, the lower end edge 51 of the back plate 7 is bent inward in a substantial horizontal direction, and a plurality of screw holes 52 to 52*f* are formed in the bent portion of the lower end edge 51. As seen from FIG. 3A, the lower end portions 53*a* to 53*c* of the securing plates 21*a* to 21*c* are also bent substantially horizontally, and a plurality of screw holes 54*a* to 54*c* is formed in each of the lower end portions 53*a* to 53*c*. The horizontally-bent portion of the lower end edge 51 of the back plate 7 is generally at the same height as the lower surface of the bottom plate 5 while the lower end portions 53*a* to 53*c* of the securing plates 21*a* to 21*c* are generally at the same height as the upper surface of the bottom plate 5, so that the bottom plate 5 can be held between the lower end edge 51 of the back plate 7 and the lower end portions 53*a* to 53*c* of the securing plates 21*a*. When the rear casing section 3 is to be attached to the main casing section 2, a rear edge portion of the bottom plate 5 is fitted between the lower end edge 51 of the back plate 7 and the lower end portions 53*a* to 53*c*. Specifically, the lower end edge 51 of the back plate 7 is brought into contact with the lower surface of the bottom plate 5 and screwed to the bottom plate 5 through screws driven in the screw holes 52*a* to 52*f*. Further, the lower end portions 53*a* to 53*c* of the securing plates 21*a* to 21*c* are brought into contact with the upper surface of the bottom plate 5 and screwed to bottom plate 5 through screws driven in the screw holes 54*a* to 54*c*. Such screwing operations are all performed from below the bottom plate 5 as seen in FIG. 1C. Because the lower end edge 51 of the back plate 7 and the lower end portions 53*a* to 53*c* of the securing plates 21*a* to 21*c* are screwed together at a plurality of positions, and because the respective screwed positions of the lower end edge 51 and the lower end portions 53*a* to 53*c* are deviated from each other in the front-and-back direction of the keyboard musical instrument, the rear casing section 3 attached to the main casing section 2 can be effectively prevented from rattling in the front-and-back direction.

To detach the rear casing section 3 from the main casing section 2, the screws are removed from the underside of the bottom plate 5, and the rear casing section 3 is slid in the rearward direction of the keyboard musical instrument (i.e., in a direction opposite to arrow X). Thus, the fastening engagement between the projections 31*a* to 31*d* of the rear casing section 3 and the tapered surfaces 39*a* of the slide portions 35*a* to 35*d* can be released. During the sliding movement, the screw heads 33*a*, 33*b* of the slidingly-attaching projections 31*a* to 31*d* are stopped by the adjusting protrusions 40*a* of the slide portions 35*a* to 35*d* so that they are positioned immediately below the corresponding large openings 36*a*, 36*b* and thus movable upward through the large openings 36*a*, 36*b*. Then, in the position where the screw heads 33*a*, 33*b* of the slidingly-attaching projections 31*a* to 31*d* have been stopped by the adjusting protrusions 40*a*, it is possible to readily detach the rear casing section 3 from the main casing section 2 by just lifting the rear casing section 3.

Referring back to FIGS. 3A and 3B, main circuit boards 22*a* and 22*b* including tone sources etc., are mounted on the back plate 7, and a circuit board 60 of the operation panel 12 is mounted on a portion of the underside of the roof plate 4 below the operation panel 12. Because these circuit boards are mounted on the rear casing section 3, they can be attached and detached to the and from the main casing section 2 together with the rear casing section 3. When maintenance operations are to be performed on the circuit boards within the casing 1, it is only necessary that the rear casing section 3 be detached from the main casing section 2 by being slid rearward and then be placed in an appropriate position for the intended operations. Therefore, the maintenance and inspection operations can be performed with ease. Further, because there is no need to provide a particular space on the bottom plate 5 for mounting the main circuit boards 22*a*, 22*b* etc., it is possible to reduce the dimension, in the front-and-back direction, of the bottom plate 5, and hence reduce the overall size and weight of the keyboard musical instrument.

The embodiment has been described in relation to the case where the right and left side plates 6*a* and 6*b* belong to and are provided integrally with the main casing section 2; conversely, the right and left side plates 6*a* and 6*b* may belong to and be provided integrally with the rear casing section 3. In such a modification too, the basic technical concept of the present invention that the rear casing section 3 is detachably attachable to the main casing section 2 from behind the casing section 2 can be reflected appropriately. In this case, although the roof plate 4 and side plates 6*a* and 6*b* are of course secured together by means of L-shape mounting hardware applied to the inner surfaces of these plates, the front surfaces of the right and left side plates 6*a* and 6*b* and the right and left ends of the keyslip portion 8 are merely held in butting engagement with each other, rather than in fitting engagement with each other. Namely, the side plates 6*a* and 6*b* and keyslip portion 8 may be constructed such that as the side plates 6*a* and 6*b* are slid forward, the inner edge of the front of the side plates 6*a* and 6*b* are brought into overlap and soft contact with the opposite end surfaces of the keyslip portion 8. Preferably, the keyslip portion 8 and the bottom plate 4 are joined with each other by means of connecting hardware that is a smaller and simplified version of the above-mentioned the securing plates 21*a* to 21*c* or L-shape connecting hardware.

Figure 6A:
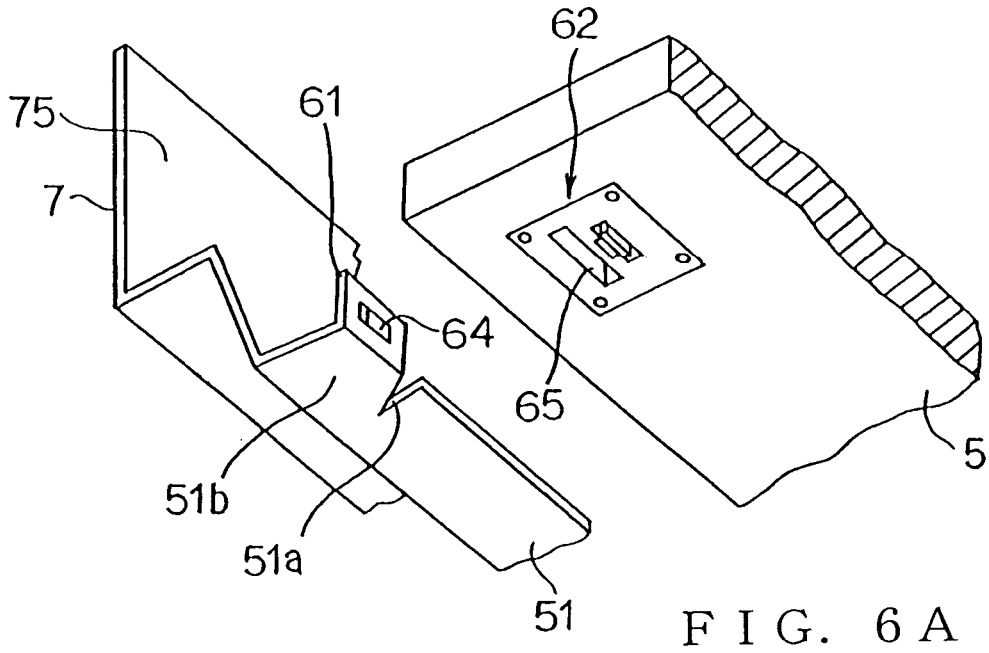
FIG. 6A is a schematic perspective view showing another embodiment of a lower attaching mechanism for attaching the rear casing section to the main casing section.
Figure 6B:
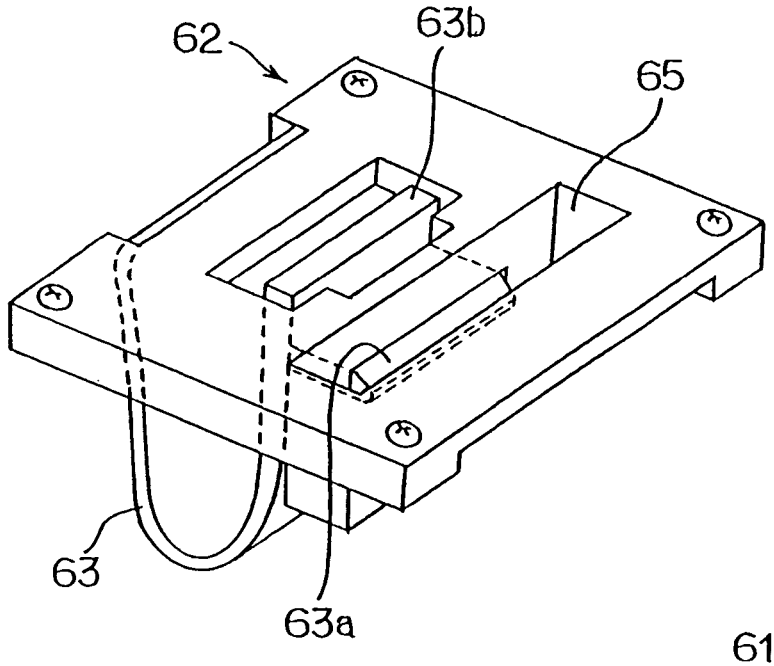
FIG. 6B is a schematic perspective view showing an example of a snap-fitting engaging unit.

Further, in the above-described embodiment, the rear lower end of the rear casing section 3 and the main casing section 2 are secured to each other by screwing. In a modified embodiment, the rear lower end of the rear casing section 3 and the main casing section 2 may be secured to each other by means of a resiliently-deformable fitting members (snap-fitting members). FIG. 6A is a schematic perspective view showing parts of the bottom plate 5 and back plate 7 from below these plates 5 and 7; for convenience, there are only shown respective left end portions of the bottom and back plates 5 and 7. In the illustrated example, the lower end edge 51 of the back plate 7 has a recess or notch 51*a* formed in its base 51*b* and an upward fitting projection (upward bent portion) 61 formed on the base 51*b* in adjoining relation to the recess 51*a*, and the upward fitting projection 61 has an engaging hole portion 64. Resiliently-deformable fitting engagement unit 62 is provided on a portion of the underside of the bottom plate 5 which corresponds in position to the upward fitting projection 61. FIG. 6B is an enlarged perspective view of the fitting engagement unit 62, which shows the fitting engagement unit 62 from above to facilitate understanding. The fitting engagement unit 62 has a recess 65 to permit entry therein of the upward fitting projection 61, and a resilient fitting member 63. The resilient fitting member 63 also has an engaging protrusion 63*a* located immediately inward of the operating portion 63*b* and facing the recess 65. The engaging protrusion 63*a* has a distal end portion having a tapered sectional shape with only one side surface (upper surface) slanted downward with respect to the other side surface (lower surface), and the resilient fitting member 63 is resiliently deformable so that the engaging protrusion 63*a* is movable in and out of the recess 65.

Figure 6C:
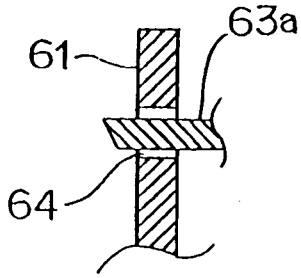
FIG. 6C is a sectional view schematically showing a state where an engaging protrusion is fitted in an engaging hole portion.

To join the back and bottom plates 7 and 5, the fitting projection 61 formed on the lower end edge 51 of the back plate 7 is inserted in the recess 65 of the fitting engagement unit 62 provided on the bottom plate 5, so that the tapered end portion of the engaging protrusion 63*a* is first pressed by the fitting projection 61 until the protrusion 63*a* is moved out of the recess 65. Then, as the insertion of the fitting projection 61 progresses, the pressing force applied by the projection 61 to the protrusion 63*a* is released at the position of the engaging hole portion 64, upon which the engaging protrusion 63*a* is pushed back into the recess 65 by the resilient force of the resilient fitting member 63 and thus the engaging protrusion 63*a* is brought into fitting engagement with the engaging hole portion 64. FIG. 6C is a sectional view showing a state where the protrusion 63*a* is fitted in the engaging hole portion 64 in the manner as stated above. By the fitting engagement, the back and bottom plates 7 and 5 are joined or secured with respect to each other. During the time that the fitting projection 61 is fitted in the recess 65, the recess 51*a* in the lower end edge 51 of the back plate 7 allows the base 51*b* to have some resiliency such that the back plate 7 can have considerable flexibility with respect to the bottom plate 5 and thus can be smoothly fitted in the bottom plate 5.

Further, the resilient fitting member 63 has the upper-end operating portion 63*b* extending at a substantially right angle to the engaging protrusion 63*a*, and this operating portion 63*b* is operable to compulsorily release the fitting engagement between the engaging protrusion 63*a* and the engaging hole portion 64. To disjoin the back plate 7 and bottom plate 5 from each other, the operating portion 63*b* is pulled to move the engaging protrusion 63*a* out of the recess 65, so as to release the fitting engagement between the engaging protrusion 63*a* and the engaging hole portion 64. Then, the fitting projection 61 is removed from the recess 65.

The use of the two resiliently-deformable fitting means (i.e., the resilient fitting member 63 and base 51*b*) can completely eliminate the need for screwing to join the main casing section 2 and rear casing section 3, so that the operations for joining and disjoining the main casing section 2 and rear casing section 3 can be performed with increased ease.

Note that the slidingly-attaching structure in the present invention need not necessarily be of the above-described type and may be constructed in any other desired manner as long as it allows the rear casing section 3 to be slid along and then ultimately attached to the main casing section 2. Further, whereas the embodiments have been described in relation to the case where the lower surface of the roof plate 4 and the upper surfaces of the side plates 6*a*, 6*b* are brought into engagement with each other and slid relative to each other in the front-and-back direction, the construction of the present invention is not so limited. For example, the present invention may be constructed so that the inner surface 75 of the back plate 7 and the rear end surfaces of the side plates 6*a*, 6*b* are brought into engagement with each other and slid relative to each other in the vertical direction.

Further, whereas the embodiments have been described in relation to the case where the back plate 7 of the rear casing section 3 and the roof plate 4 are joined at substantially right angles, the back plate 7 and the roof plate 4 may be joined at any other appropriate angle, such as 60 or 120 degrees.

Furthermore, where only the arrangement of mounting the main circuit boards etc. on the rear casing section 3 is employed, other appropriate means than the above-described slidingly-attaching structure may be used to detachably join the rear casing section 3 and main casing section 2.

Figure 7A:
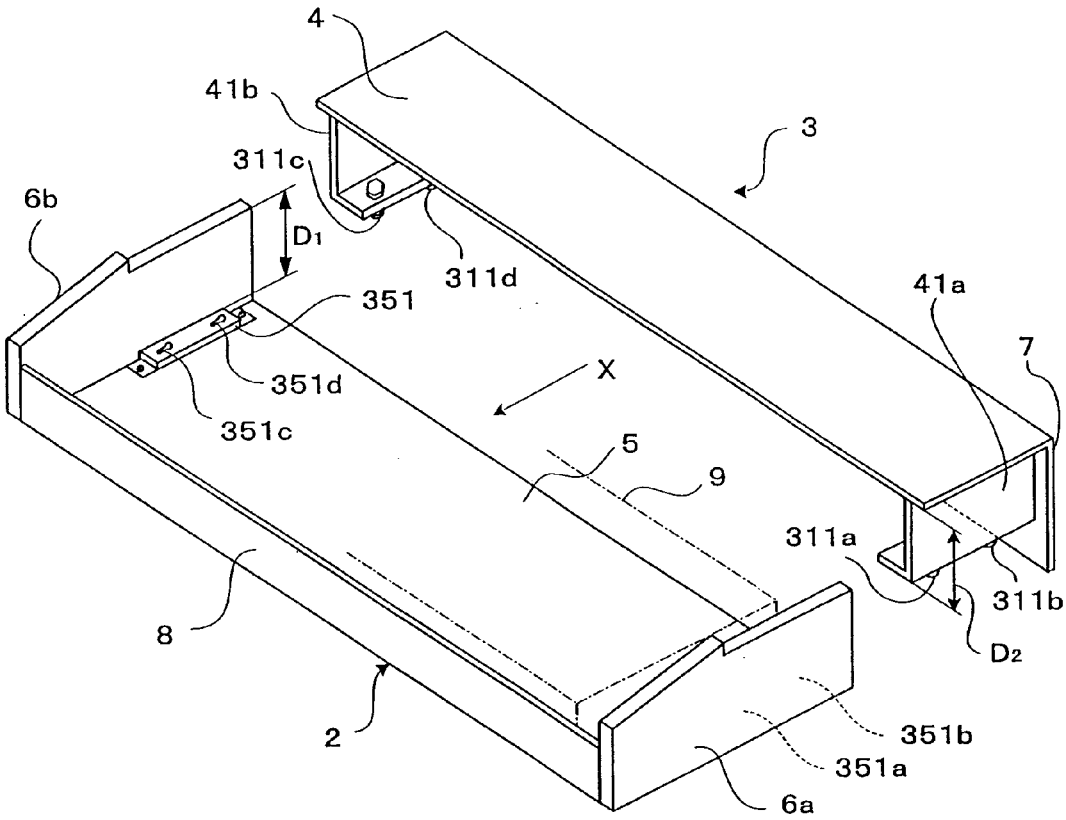
FIG. 7A is a schematic exploded perspective view showing another embodiment of the slidingly-attaching structure for slidingly attaching the rear casing section to the main casing section.
Figure 7B:
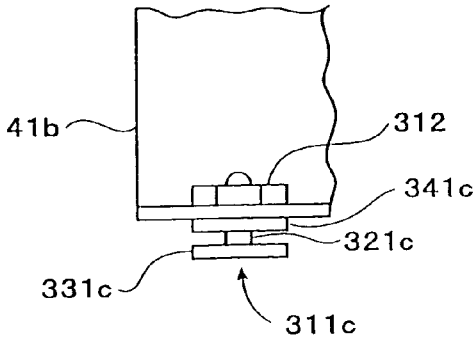
FIG. 7B is a side view of a slidingly-attaching projection provided on the rear casing section.

This and following paragraphs describe another embodiment of the slidingly-attaching structure for slidingly attaching the rear casing section 3 to the main casing section 2, with reference to FIGS. 7A and 7B. In this embodiment, slide portions 351*a* to 351*d* are provided on the bottom plate of the main casing section 2, and slidingly-attaching projections 311*a* to 311*d*, slidingly engageable with the slide portions 351*a* to 351*d* are formed on lower end edges of left and right legs 41*a* and 41*b* extending downward from the underside of the roof plate 4 of the rear casing section 3. As seen from, for example, FIG. 7A, a slide member 351 having two slide portions 351*c* and 351*d* formed thereon is mounted on one end (adjacent to one of the side plates 6*b*) of the bottom plate 5 by screwing or otherwise. Similarly, another slide member, not visible in FIG. 7A, has two slide portions 351*a* and 351*b* provided thereon is mounted on the other end (adjacent to the other side plate 6*a*) of the bottom plate 5 by screwing or otherwise. Each of the slide portions 351*a* to 351*d* has elements similar to those of the above-described slide portion 35*a* of FIGS. 5A and 5B, such as a large opening (36*a*), elongated opening (37*a*) and tapered surface (39*a*). Here, detailed illustration and description of these elements are omitted, because it is believed that FIG. 5 and the corresponding description having been given above can also be applied here appropriately.

The lower ends of the legs 41*a* and 41*b*, extending downward from the underside of the roof plate 4, are each bent inward at a substantially right angle to thereby form an elongated horizontal portion. The slidingly-attaching projections 311*a* to 311*d* are provided on and extend downward from the respective lower-end horizontal portions of the legs 41*a* and 41*b*. FIG. 7B shows one of the slidingly-attaching projections 311*c* in enlarged scale, from which it is seen that the slidingly-attaching projection 311*c* has elements similar to those of the slidingly-attaching projection 31*a* of FIG. 5B, such as a screw head 331*c*, gap portion 321*c* and flange 341*c*. The slidingly-attaching projection 311*c* is fixed to the corresponding lower-end horizontal portion of the leg 41*b* by means of a bolt and nut connection 312. The four slidingly-attaching projections 311*a* to 311*d* are provided on the legs 41*a* and 41*b* of the roof plate 4 in corresponding relation to the four slide portions 351*a* to 351*d* provided on the bottom plate 5. Although not clearly seen in FIG. 7A, the other slidingly-attaching projections 311*a*, 311*b* and 311*d* are identical in construction to the projection 311*c*.

When attaching the rear casing section 3 to the main casing section 2, the slidingly-attaching projections 311*a* to 311*d* in the embodiment of FIGS. 7A and 7B operate with the corresponding slide portions 351*a* to 351*d* in the same manner as the above-described slidingly-attaching projections 35*a* to 35*d* of FIG. 5 operating with the corresponding slide portions 35*a* to 35*d*. Therefore, the operation of the slidingly-attaching projections 311*a* to 311*d* is not described here to avoid unnecessary duplication. Namely, the presence of the tapered surfaces allow the slide portions 351*a* to 351*d* to be brought into tighter engagement with the slidingly-attaching projections 311*a* to 311*d* as the rear casing section 3 is pushed further relative to the main casing section 2. Note that a distance D1 from the upper surface of the slide portions 351*a* to 351*d* to the top of the corresponding side plates 6*a* and 6*b* is greater, by an appropriate clearance C, than a distance from the flange of the slidingly-attaching projections 311*a* to 311*d* to the lower surface of the roof plate 4; namely, D1=D2+C. With this arrangement, the rood plate 4 can be firmly pressed against the main casing section 2, which achieves very tight engagement.

In the slidingly-attaching structure, the positions of the slide portions 351*a* to 351*d*, each having the openings and tapered surface, and slidingly-attaching projections 311*a* to 311*d* may be revered from those illustrated in FIG. 7A. Namely, the slide portions 351*a* to 351*d*, each having the large opening (36*a*), elongated opening (37*a*), tapered surface (39*a*) and the like, may be provided on the lower-end horizontal portions of the corresponding legs 41*a* and 41*b* of the roof plate 4, and the slidingly-attaching projections 311*a* to 311*d* may be provided on the corresponding slide members 351 of the bottom plate 5 so as to extend upwardly. Also, in a case where the slide portions 35*a* to 35*d* are provided on the side plates 6*a* and 6*b* as in the example of FIG. 5, the positions of the slide portions 35*a* to 35*d*, each having the openings and tapered surface, may be reversed from those in the above-described embodiment. Namely, the slide portions 35*a* to 35*d*, each having the large opening (36*a*), elongated opening (37*a*), tapered surface (39*a*) and the like, may be provided on the underside of the roof plate 4, and the slidingly-attaching projections 31*a* to 31*d* may be provided on the upper surfaces of the corresponding side plates 6*a* and 6*b* so as to extend upwardly.

In summary, the present invention arranged in the above-described manner can provide an electronic keyboard musical instrument having an improved casing structure that can be assembled with ease in such a manner as to present good appearance in an assembled state and also facilitates maintenance and inspection of the interior of the casing.

The present invention relates to the subject matter of Japanese Patent Application No. 2001-285072 filed on Sept. 19, 2001, the disclosure of which is expressly incorporated herein by reference in its entirety.

What is claimed is:

1. An electronic keyboard musical instrument comprising a keyboard section and a casing that accommodates therein said keyboard section, said casing comprising:

a main casing section including a bottom plate having said keyboard section placed thereon, and a keyslip portion extending upward from said bottom plate in front of said keyboard section; and a rear casing section including a roof plate forming a rear upper surface of said casing, and a back plate extending downward from a rear edge of said roof plate, wherein a speaker, a tone hole which a sound outputted via said speaker to escape therethrough and a main circuit board of said electronic keyboard musical instrument are provided on said rear casing section, wherein said rear casing section is detachably attached to said main casing section along with said speaker, said tone hole and said main circuit board, and wherein said main circuit board is provided along said back plate, wherein said rear casing section includes a securing plate extending forward from the back plate, with the upper end portion of the securing plate in contact with the roof plate, and the lower end portion of the securing plate in contact with the bottom plate, and wherein the main circuit board includes two separate board parts that are provided on the back plate and respectively positioned at right and left sides of the securing plate.

2. An electronic keyboard musical instrument according to claim 1, wherein all of said speaker, said tone hole and said main circuit board are provided on said back plate of said rear casing.

* * * * *